US008636440B1

(12) United States Patent
Cudak et al.

(10) Patent No.: US 8,636,440 B1
(45) Date of Patent: Jan. 28, 2014

(54) ROAD TRACTION APPARATUS

(71) Applicant: International Business Machines Corporation, Armonk, NY (US)

(72) Inventors: Gary D. Cudak, Creedmoor, NC (US); Christopher J. Hardee, Raleigh, NC (US); Randall C. Humes, Raleigh, NC (US); Adam Roberts, Moncure, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/717,746

(22) Filed: Dec. 18, 2012

(51) Int. Cl.
*E01F 9/06* (2006.01)
*E01F 11/00* (2006.01)

(52) U.S. Cl.
USPC ..... 404/19; 404/12; 404/71

(58) Field of Classification Search
USPC ..... 404/11–18, 71
See application file for complete search history.

(56) References Cited

U.S. PATENT DOCUMENTS

| | | | | |
|---|---|---|---|---|
| 1,863,316 | A | 6/1932 | Webster, Jr. | |
| 4,210,280 | A | 7/1980 | Reisner | |
| 4,595,312 | A | 6/1986 | Corless | |
| 4,597,691 | A | 7/1986 | Clarke | |
| 5,221,379 | A | 6/1993 | Nicholas | |
| 5,302,048 | A | 4/1994 | Paulos et al. | |
| 6,592,288 | B2 | 7/2003 | Chun | |
| 7,258,507 | B2 | 8/2007 | Kim et al. | |
| 7,347,643 | B2 * | 3/2008 | Jeong | 404/13 |
| 2003/0077121 | A1 | 4/2003 | Chun | |
| 2004/0209594 | A1 | 10/2004 | Naboulsi | |

FOREIGN PATENT DOCUMENTS

| | | | |
|---|---|---|---|
| GB | 2041047 | A | 9/1980 |
| GB | 2478786 | A | 9/2011 |
| JP | 59190009 | A | 10/1984 |

OTHER PUBLICATIONS

Boys, et al. "Intelligent road-studs—lighting the paths of the future", IPENZ Trasactions, pp. 33-41; vol. 24, No. 1/ GEN, 1997.

Parker, Dick. "Evaluation of Ice Alert®—Final Report—State Research Project OR-95-16", Research Unit Oregon Department of Transportation, Mar. 1995.

Wikipedia, The Free Encyclopedia. "Thermochromism: Difference between revisions"; Aug. 11, 2011 version, printed Aug. 4, 2012 <http://en.wikipedia.org/w/index.php?title=Thermochromism&diff=443677314&oldid=443677211>.

Woodford, Chris. ExplainThatStuff, "How color-changing thermochromic materials work", last updated Feb. 12, 2011, <http://www.explainthatstuff.com/thermochromic-materials.html>.

(Continued)

*Primary Examiner* — Raymond W Addie
(74) *Attorney, Agent, or Firm* — Matthew Mottice

(57) ABSTRACT

Aspects of the present invention disclose an apparatus for increasing roadway traction. An exemplary apparatus includes a housing and a shaft that engages a first end of the housing. A piston is adapted to move axially along a length of housing and includes an upper portion and lower portion. The upper portion includes a raised surface and a mating portion situated between the raised surface and lower portion. The lower portion includes an interior cavity that is adapted to receive at least a portion of the shaft. A spring that biases the piston toward the first end of the housing. A toothed surface engaged with the piston and a bimetal thermostat with a mating toothed surface. The toothed surface engaged with the lower portion facilitates engagement with the mating toothed surface situated at the distal end of the bimetal thermostat when the temperature is above a predetermined threshold.

17 Claims, 4 Drawing Sheets

(56) References Cited

OTHER PUBLICATIONS

"Automatic Reractable Bollards", Calpipe Security Bollards—The Bollard Specialists, Downey, CA, printed Jul. 26, 2012 <http://www.calpipebollards.com/Automatic-Retractable-Bollards.html>.
"Causes of Skidding and Loss of Traction", Lewis County Driving School, Centralia, WA, Lesson 7, Copyright © 2001-2011, printed Jul. 26, 2012 <http://www.lewiscountydrivingschool.com/SS_Lesson_7.html>.
"Snow and Ice Response Plan—City of Kent, Washington", Copyright 2012 © City of Kent, Washington, printed Jul. 26, 2012 <http://www.ci.kent.wa.us/content.aspx?id=11016&terms=snow>.

* cited by examiner

ROAD TRACTION APPARATUS

FIELD OF THE INVENTION

The present invention relates generally to roads and more specifically to a road traction apparatus for providing traction adjustments to a road surface.

BACKGROUND

Ice and other forms or precipitation on highways is one of the leading causes of traffic accidents. A thin transparent layer of ice or precipitation may cause total or partial loss of traction in situations where a driver of a vehicle may not even be aware that the ice or precipitation was present. Known techniques that attempt to provide traction to road surfaces either need human involvement, such as salt trucks, etc. or need some form of external power source, such as electricity.

SUMMARY

Aspects of the present invention disclose an apparatus for increasing roadway traction. Exemplary embodiments of the apparatus include a housing with a first end and a second end, wherein the first end is closed and the second end is open. Exemplary embodiments of the apparatus include a shaft that engages the first end of the housing. Exemplary embodiments of the apparatus include a piston that is adapted to move axially along a length of housing and includes an upper portion and lower portion. The upper portion includes a raised surface adapted to provide improved traction for vehicles; a mating portion situated between the raised surface and lower portion and is adapted to mate with the inner surfaces of housing such that the piston is reciprocally received therewithin. The lower portion includes an interior cavity that is adapted to receive at least a portion of the shaft. Exemplary embodiments of the apparatus include a spring that biases the piston toward the first end of the housing. Exemplary embodiments of the apparatus include a toothed surface engaged with the piston and a bimetal thermostat with a mating toothed surface. The bimetal thermostat is secured with the housing at a proximal end. In exemplary embodiments of the apparatus the toothed surface engaged with the lower portion facilitates engagement with the mating toothed surface situated at the distal end of the bimetal thermostat when the temperature is above a predetermined threshold.

DETAILED DESCRIPTION

Figure 1:
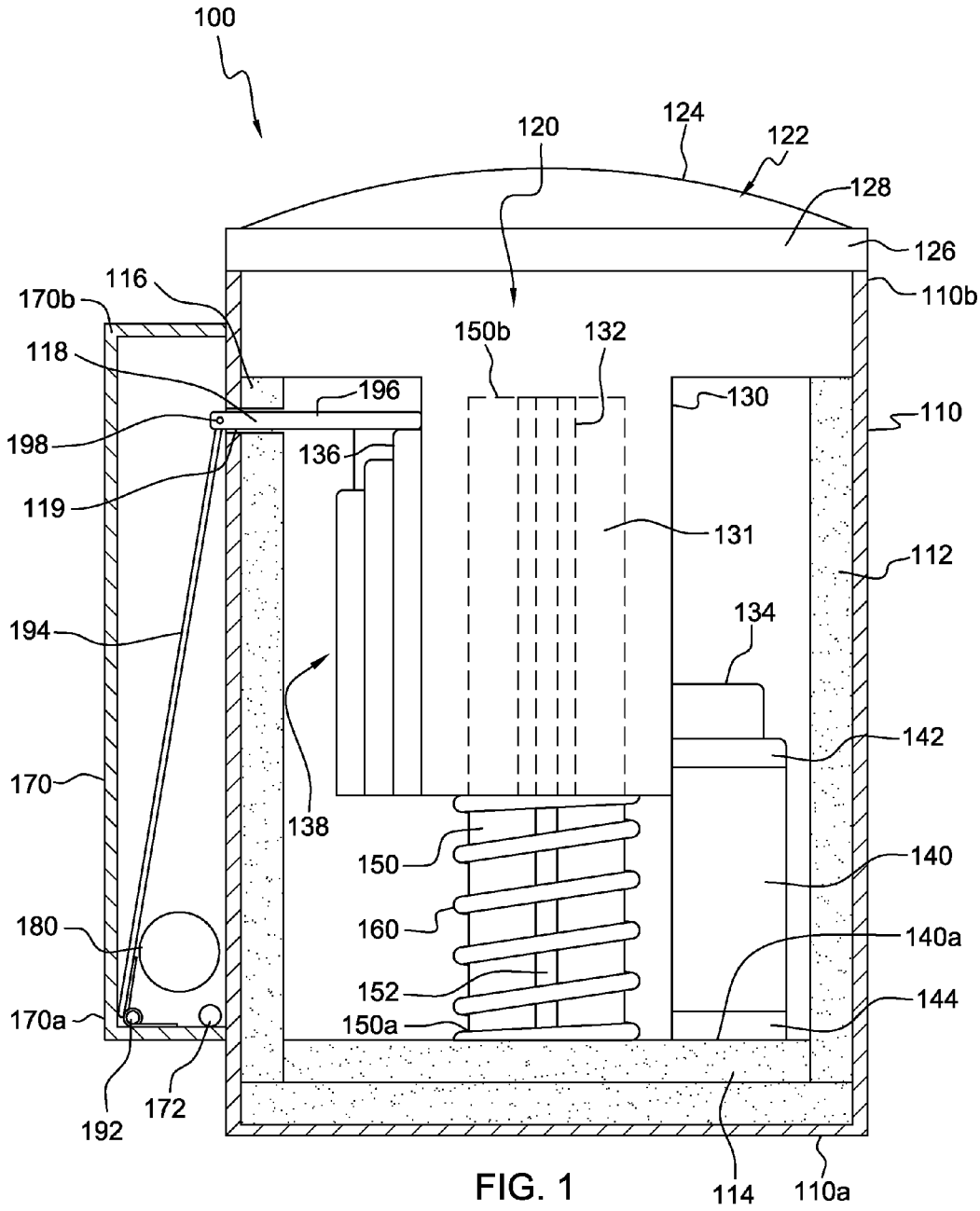
FIG. 1 depicts a side elevated view of an example of a road traction apparatus with a piston engaged within a housing according to the present invention.

The present invention will now be described in detail with reference to the figures.

FIG. 1-4 illustrates a road traction apparatus generally designated 100 for providing traction adjustments to a road surface according to one embodiment of the present invention. FIGS. 1-4 provide only an illustration of one implementation and do not imply any limitations with regard to the environments in which different embodiments may be implemented. Many modifications to the depicted environments may be made.

Generally, road traction apparatus 100 may provide a kinetic mechanical system installed within an area of road surface where a lack of traction and/or warning is a larger potential danger than in other areas. In some examples, the area of road surfaces may include, but is not limited to: curves, near tollbooths, near stoplights and stop signs, etc. Exemplary embodiments of road traction apparatus 100 may at certain predetermined temperatures provide warning and/or increased potential traction for vehicles by providing a surface that rises above the road surface where ice or precipitation has accumulated. Furthermore, exemplary embodiments of road traction apparatus 100 may inherently provide a mechanism to facilitate the breaking of accumulated ice by providing force on the accumulated ice.

An exemplary embodiment of road traction apparatus 100 includes a housing 110. In exemplary embodiments, housing 110 is substantially cylindrical in geometry, with a first end 110*a* and a second end 110*b*. In an exemplary embodiment, second end 110*b* is closed by a substantially planar plate 112. However, in other exemplary embodiments, other geometries of bodies may seal the second end 110*b* of housing 110. Furthermore, in other examples, housing 110 may be different geometries that allow a piston 120 to move within an internal cavity 114 that passes axially through housing 110. Exemplary embodiments of housing include a geometry required to produce a mating engagement between a portion of the piston and at least an inner surface of housing 110.

Figure 2:
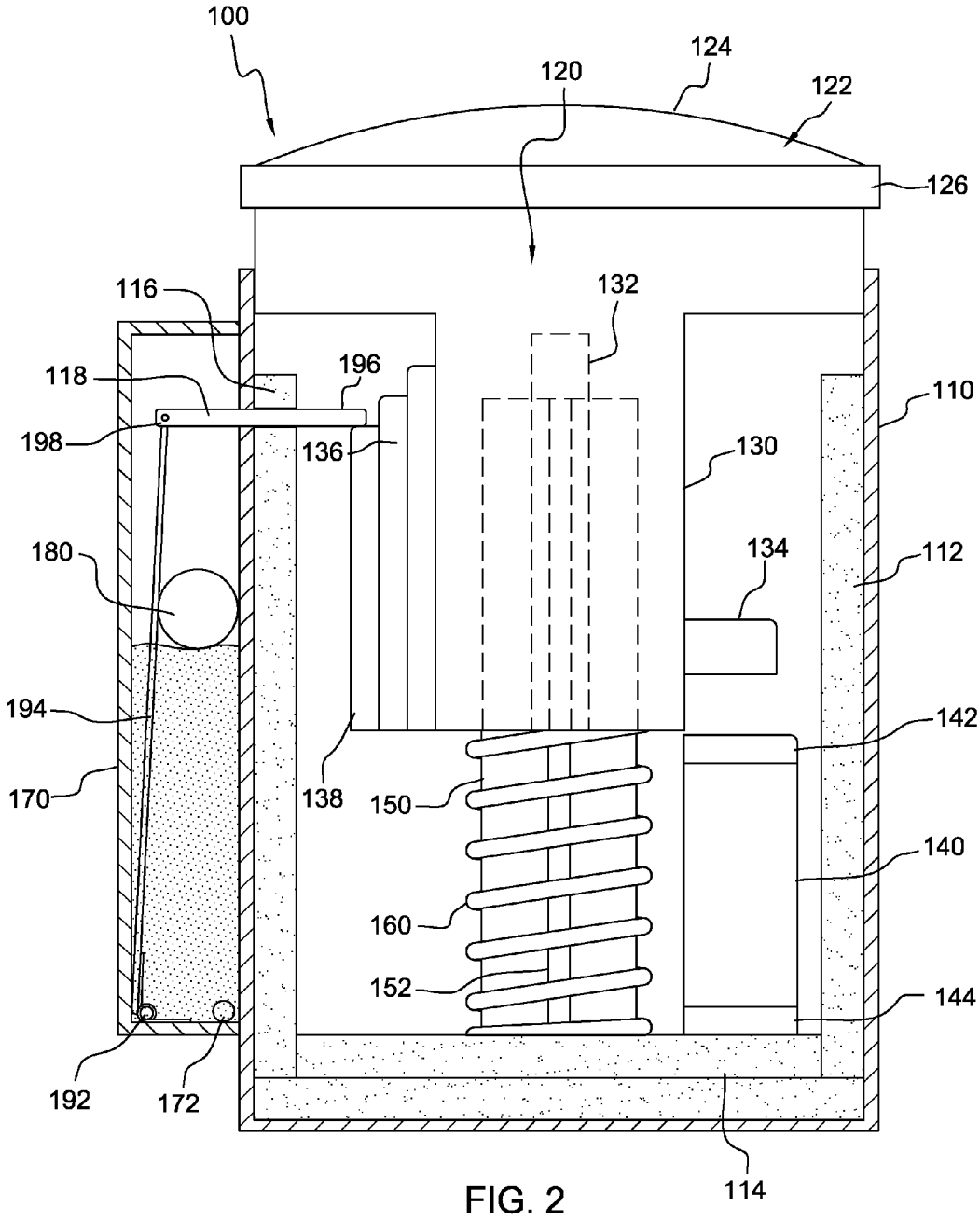
FIG. 2 depicts a side elevated view of an example of a road traction apparatus with a piston unengaged within a housing according to the present invention.

Exemplary embodiments of housing 110 include one or more sealing members. As depicted in FIGS. 1 and 2, housing 110 includes a seal 116 and a seal 118. Seal 116 encircles the inner wall of housing 110 to produce a hermetic seal between piston 120 and housing 110 to prevent moisture from entering interior cavity 114 In exemplary embodiments, seal 116 is attached to housing 110 by In exemplary embodiments, seal 116 may be made of any number of materials, such as rubber, plastic, etc. In some exemplary embodiments, seal 118 is integral with seal 116. However in other exemplary embodiments, seal 118 is attached with seal 116 by adhesive, fasteners, etc. The combination of seal 116 and seal 118 provide a hermetic seal to prevent moisture from entering interior cavity 114. In exemplary embodiments, housing 110 and seal 116 includes a keyhole 119 that protrudes through a portion of the housing 110 and seal 116 and is adapted to allow a key member 196 to slide within the interior and/or exterior of housing 110. Further detail of the operation of keyhole 119 and key member 196 will be discussed later herein.

Exemplary embodiments of road traction apparatus 100 include a shaft 150 that is engages plate 112 of housing 110 at a proximal end 150*a*. Shaft 150 is secured to plate 112 of housing 110 by known fabrication techniques, or may be integral with housing 110. Although shaft 150 is substantially cylindrical in the depicted embodiment, shaft 150 may have any number of cross-sectional geometries that allow piston 120 to axially move along the length of housing 110. Exemplary embodiments of shaft 150 include a key 152 running along a length thereof. Key 152 complements a keyway 132 situated within an interior cavity 131 of a lower portion 130 of piston 120. The combination of complementary key 152 and keyway 132 allows for the piston 120 to move axially along the length of housing 110 while restricting rotation of the piston 120 relative to housing 110. Other exemplary embodiments of road traction apparatus 100 may include different forms of mechanism to prevent the rotational movement of piston 120 relative to housing 110. In another example, interior cavity 131 includes a key and shaft includes a complementary keyway. In other examples, where the shaft is non-circular, the interior cavity may have a complementary geometry that prevents rotation of the piston relative to the housing.

Exemplary embodiments of road traction apparatus include a spring 160, as depicted in FIGS. 1 and 2. As depicted, spring 160 is a compression coil spring, but may also be another type of elastic element, such as an element fabricated of a visco-elastic polymer. As can be seen, spring 160 biases the piston 120 toward the first end 110*a* of housing 110. Therefore, when no (or an insufficient) contrary (compression) force is exerted against piston 120, spring 160 biases piston 120 to the maximum height until key member 196 engages a step-like protruding member 136 situated on lower portion 130 of piston 120.

Exemplary embodiments of road traction apparatus 100 include piston 120 that is adapted to move axially along a length of housing 110. Exemplary embodiments of piston 120 include an upper portion 122 and lower portion 130. Upper portion 122 and lower portion 130 may be integral in some embodiments, or may be secured together in other embodiments.

Exemplary embodiments of upper portion 122 include a raised surface 124. Raised surface 124 is adapted to provide improved traction for vehicles. As such, any number of geometries may be used for raised surface 124. Exemplary embodiments of upper portion 122 include a mating portion 126 situated between the raised surface 124 and lower portion 130. At least a portion of mating portion 126 is adapted to mate with the inner surfaces of housing 110 such that piston 120 is reciprocally received therewithin. Exemplary embodiments of the length of mating portion 126 is such that at least a portion of mating portion engages housing 110 whether or not piston is depressed or floating within. In some examples, at least a portion of mating portion 126 includes a reflective substance 128 or device adhered thereto adapted to provide a reflection of vehicle lights so that a driver of a vehicle can see that road traction apparatus 100 is activated and the roadway surface may be adverse.

As described herein, an exemplary embodiment of interior cavity 131 of lower portion 130 includes keyway 132 to prohibit rotational movement of piston 120. Interior cavity 131 passes axially through lower portion 130 to a depth that allows shaft 150 to move therewithin so that a distal end 150*b* of shaft 150 does not engage the bottom of interior cavity 131 when piston 120 is fully depressed within housing 110.

Exemplary embodiments of lower portion 130 may include a step-like member 136. Step-like member 136 facilitates the maximum height of piston 120 relative to the housing 110 depending upon the amount of moisture drainage. In the depicted embodiment, step-like member 136 includes three different step heights. However in other exemplary embodiments, other amounts of step heights may be used.

Exemplary embodiments of lower portion 130 include a toothed surface 134 secured thereto. Toothed surface 134 facilitates releasable engagement with a mating toothed surface 142 situated at a distal end 140*b* of a bimetal thermostat 140.

Exemplary embodiments of bimetal thermostat 140 facilitate the engagement and disengagement of toothed surface 134 of piston 120 and toothed surface 142 of bimetal thermostat 140. Exemplary embodiments of bimetal thermostat 140 may be secured with housing 110 at a proximal end 140*a* by a housing body 144. However, in other exemplary embodiments, bimetal thermostat 140 is secured directly with housing 110. Exemplary embodiments of bimetal thermostat may include a bimetal spiral thermostat that includes a spiral shaped piece of metal composed of two metals bonded together side by side. The two metals have different expansion properties with respect to temperature and as a result uncurl at a reasonably precise rate per temperature change so as to not only allow for accurate temperature measurement but also allow for a physical movement to take place as is the case in industrial dial type thermostats of this nature.

Figure 3:
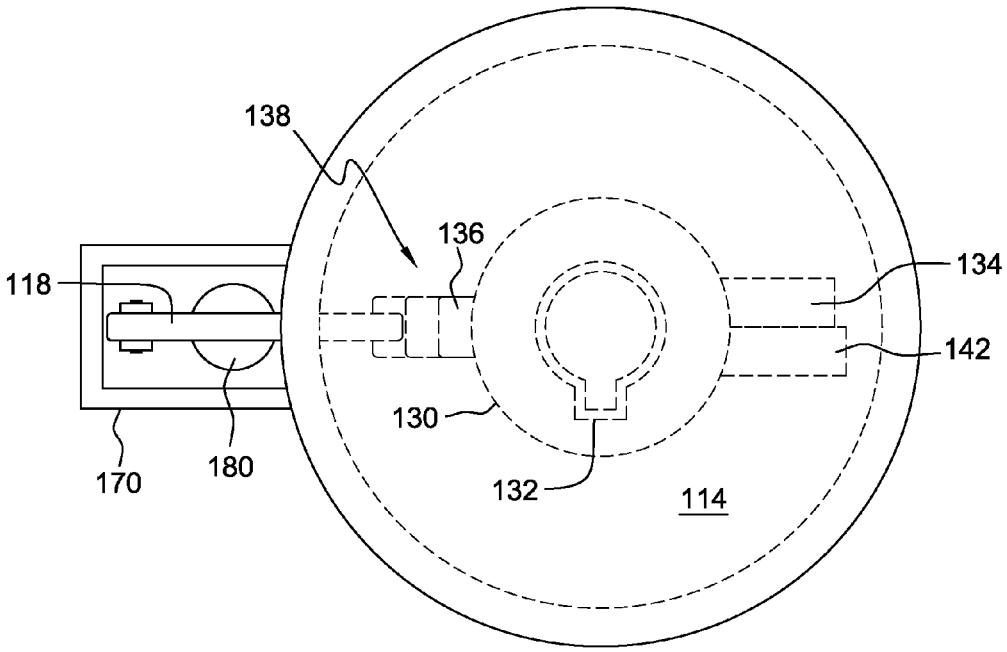
FIG. 3 depicts a top plan view an example of a road traction apparatus according to the present invention.

Exemplary embodiments of road traction apparatus 100 may include an optional moisture container 170 that engages an outside wall of housing 110. Typically, moisture body 170 is secured to the periphery of housing 110 such that moisture body substantially surrounds keyhole 119. Exemplary embodiments of moisture body 170 may be substantially cuboid, as depicted in FIG. 3, with an opening at a first end 170*a* to allow moisture to accumulate within moisture body 170 when weather includes precipitation. However, in other embodiments, the cross-sectional geometry of moisture body 170 may vary to allow a ball float 180 to operate within moisture body 170. Exemplary embodiments of moisture body 170 includes at least one drain 172 positioned at a predetermined height and with a predetermined cross-sectional geometry and size to allow the moisture accumulated within moisture body 170 to drain at a predetermined rate.

In exemplary embodiments, ball float 180 is substantially spherical in geometry, although exemplary embodiments may have other geometries. Exemplary embodiments of ball float 180 possess buoyancy sufficient enough to bias a moisture arm 194 connected to key member 196 when enough moisture accumulates within moisture body 170 to bias ball float towards first end 170*a* of moisture body.

Exemplary embodiments of road traction apparatus may include moisture arm 194 pivotably connected 192 with moisture body 170, and pivotably connected with key member 196. Moisture arm 194 may have any number of cross-sectional geometries that facilitate engagement along the length thereof with ball float 180 as moisture accumulates within the interior cavity of moisture body 170.

Exemplary embodiments of road traction apparatus 100 may increase traction on a roadway by providing a retractable surface that may provide additional traction for vehicle tires in wet and/or icy conditions, and may break up ice sheens during the movement of piston 120. Additionally, exemplary embodiments of road traction apparatus 100 may provide a reflective surface to warn drivers of unsafe driving conditions.

Figure 4:
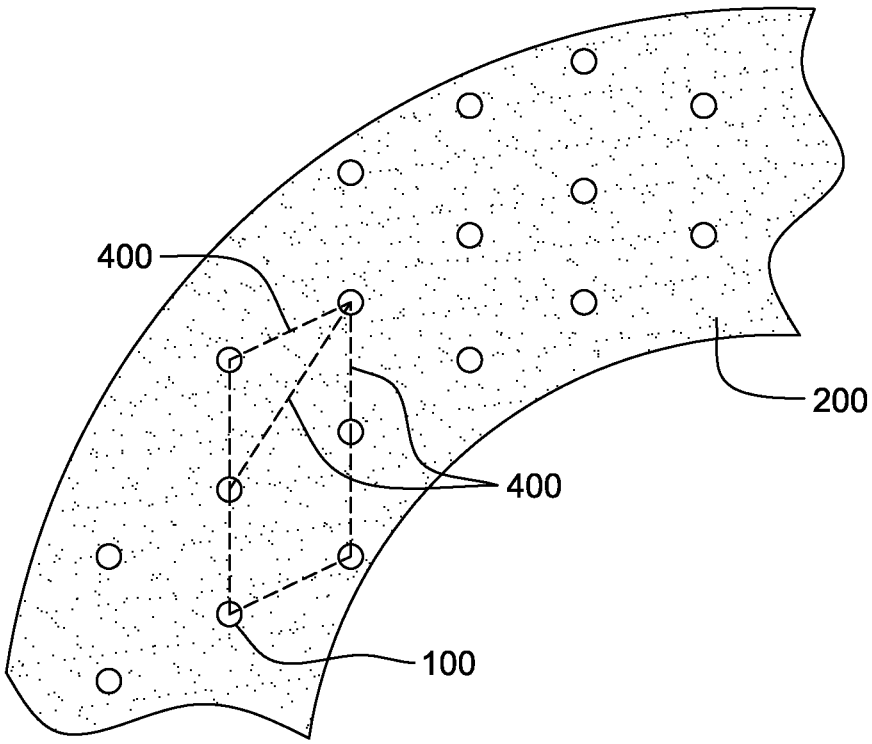
FIG. 4 depicts an example of a road traction apparatus arrangement within a roadway according to the present invention.

In operation, exemplary embodiments of road traction apparatus 100 is a self-contained unit that provides a rough surface stationed slightly above the roadway surface. As a vehicle drives over road traction apparatus 100, spring 160 will compress to allow piston 120 to be pressed within housing 110 where spring 160 engages. Furthermore, when the ambient temperature drops below a certain threshold, bimetal thermostat 140 bias toothed surface 142 away from mating toothed surface 132, allowing spring to decompress and elevating raised surface 124 of piston 120 above roadway surface 200, as depicted in FIG. 4. Typically, but not necessarily, toothed surfaces 134 and 142 disengage when temperatures are below the point of freezing roadway conditions.

After toothed surfaces 134 and 142 disengage, road traction apparatus functions to provide additional traction when vehicles drive over the device. Spring 160 has a high enough spring constant to provide a sufficient force to allow a vehicle to compress spring 160 within housing 110, but still allow raised surface 124 of piston 120 to provide additional traction for vehicle. Road traction apparatus 100 may also include reflective surface 128 as depicted in FIG. 1 to alert drivers of possible road hazards due to temperature. Furthermore, the fact that piston 120 moves up and down as each vehicle drives over road traction apparatus 100 may allow for any road surface ice sheen that may be forming to be broken up with the mechanical action of piston 120.

In the event road traction apparatus 100 is in an environment that is not conducive to freezing, road traction apparatus 100 toothed surface 134 engages toothed surface 142 to hold piston 120 in a position wherein raised surface 124 stays either at or near the road surface level, as depicted in FIG. 2.

In operation, piston 120 may be latched in the down position when the roadway conditions warm above freezing conditions, so that the raised surface 124 stays either at or near the roadway surface level. As the roadway conditions leave freezing levels, bimetal thermostat 140 bias so that toothed surface 142 exerts a force against mating toothed surface 134. When a vehicle drives over road traction apparatus 100, piston 120 travels downward into housing 110, mating toothed surfaces 134 and 142 so that piston 120 is back to a resting position wherein raised surface 124 stays either at or near the road surface level.

Additionally, in exemplary embodiments, height of piston 120 may also be adjusted depending upon the amount of moisture accumulated within moisture body 170. As explained earlier, ball float 180 is housed in moisture body 170 with access to roadway moisture drainage. As the moisture accumulates within moisture body 170, the buoyancy of ball float 180 allows ball float 180 to move upwards towards the open end of moisture body 170. The upward movement of ball float 180 also causes ball float 180 to engage moisture arm 194 that is pivotably connected 192 with moisture body 170, and pivotably connected 198 with key member 196. As moisture accumulates within moisture body 170, the rising ball float 180 causes moisture arm 194 to bias to a position substantially parallel to the side wall of moisture body 170. In turn, the movement of moisture arm 194 biases key member 196 in a substantially horizontal fashion within key hole 118. As key member 196 moves in a substantially horizontal axis, the maximum height of piston 120 relative to roadway surface may increase by allowing more room for the travel of the step-like member 136. In operation, at least one drain 172 positioned at a predetermined height and with a predetermined cross-sectional geometry and size to allow the moisture accumulated within moisture body 170 to drain at a predetermined rate into a duct or tube situated within the roadway.

Additionally, in some exemplary embodiments two or more road traction apparatuses 100 may be connected to some portion of a wire or other point to point physical connection 400 that resides within recesses in roadway 200 between each of the two points. As the two or more road traction apparatuses 100 spring up from lower temperatures and/or ice presence, the two or more road traction apparatuses 100 each pull up some portion of the interconnecting mechanism, providing additional surface area for traction, as depicted in FIG. 4.

Based on the foregoing, exemplary embodiments of a road traction apparatus have been disclosed. However, numerous modifications and substitutions can be made without deviating from the scope of the present invention. Therefore, the present invention has been disclosed by way of example and not limitation.

What is claimed is:

1. An apparatus for increasing road traction, comprising:

a housing with a first end and a second end, the first end closed and the second end open;

a shaft that engages the first end of the housing;

a piston that is adapted to move axially along a length of housing and includes an upper portion and lower portion, upper portion includes a raised surface adapted to provide improved traction for vehicles, a mating portion situated between the raised surface and lower portion and is adapted to mate with an inner surface of the housing such that the piston is reciprocally received therewithin, the lower portion including an interior cavity that is adapted to receive at least a portion of the shaft;

a spring that biases the piston towards the first end of the housing;

a toothed surface engaged with the piston; and a bimetal thermostat with a mating toothed surface, the bimetal thermostat secured with the housing at a proximal end;

wherein the toothed surface engaged with the lower portion facilitates engagement with the mating toothed surface situated at a distal end of the bimetal thermostat when a temperature is above a predetermined threshold.

2. The apparatus of claim 1, further comprising one or more sealing members that engage an internal wall of the housing.

3. The apparatus of claim 1, further comprising:

a step-like protruding member attached to the lower portion of the piston;

a keyhole that protrudes through a portion of the housing;

a key member that is adapted to slide within the keyhole;

a step-like protruding member attached to the lower portion of the piston;

wherein when no contrary force is exerted against the piston, the spring biases the piston until the key member engages the step-like protruding member;

a moisture container attached to an outside wall of housing such that moisture body substantially surrounds keyhole, with an opening at a first end to allow moisture to accumulate within the moisture body;

a moisture arm pivotably connected with the moisture body and pivotably connected with the key member; and a ball float positioned within the moisture body;

wherein as the moisture accumulates within the moisture body, the buoyancy of the ball float allows ball float to move upwards towards the first end of the moisture body and causes the ball float to engage and bias the moisture arm, which biases the key member such that a maximum height of the piston relative to roadway surface may increase by allowing more room for the travel of the step-like protruding member.

4. The apparatus of claim 3, wherein the moisture body includes at least one drain positioned at a predetermined height and with a predetermined cross-sectional geometry and size to allow the moisture accumulated within the moisture body to drain at a predetermined rate.

5. The apparatus of claim 1, wherein the interior cavity of the lower portion includes a keyway and the shaft includes a corresponding key to prohibit rotational movement of the piston relative to the shaft.

6. The apparatus of claim 1, wherein at least a portion of mating portion includes a reflective substance adhered thereto.

7. The apparatus of claim 1, wherein two or more apparatuses are connected to some portion of a point to point physical connection that resides within recesses in a roadway surface between the two or more apparatuses.

8. The apparatus of claim 7, wherein the two or more road traction apparatuses each pull up some portion of the point to point connection, providing additional surface area for traction.

9. An apparatus for increasing road traction, comprising:

a housing with a first end and a second end, the first end closed and the second end open;

a shaft that engages the first end of the housing;

a piston that is adapted to move axially along a length of housing and includes an upper portion and lower portion, upper portion includes a raised surface adapted to provide improved traction for vehicles, a mating portion situated between the raised surface and lower portion and is adapted to mate with an inner surface of the housing such that the piston is reciprocally received therewithin, the lower portion including an interior cavity that is adapted to receive at least a portion of the shaft;

a spring that biases the piston towards the first end of the housing;

a step-like protruding member attached to the lower portion of the piston;

a keyhole that protrudes through a portion of the housing;

a key member that is adapted to slide within the keyhole;

a step-like protruding member attached to the lower portion of the piston;

a moisture container attached to an outside wall of housing such that moisture body substantially surrounds keyhole, with an opening at a first end to allow moisture to accumulate within the moisture body;

a moisture arm pivotably connected with the moisture body and pivotably connected with the key member; and a ball float positioned within the moisture body;

wherein when no contrary force is exerted against the piston, the spring biases the piston until the key member engages the step-like protruding member;

wherein as the moisture accumulates within the moisture body, the buoyancy of the ball float allows ball float to move upwards towards the first end of the moisture body and causes the ball float to engage and bias the moisture arm, which biases the key member such that a maximum height of the piston relative to roadway surface may increase by allowing more room for the travel of the step-like protruding member.

10. The apparatus of claim 9, further comprising a toothed surface engaged with the piston; and a bimetal thermostat with a mating toothed surface, the bimetal thermostat secured with the housing at a proximal end;

wherein the toothed surface engaged with the lower portion facilitates engagement with the mating toothed surface situated at a distal end of the bimetal thermostat when a temperature is above a predetermined threshold.

11. The apparatus of claim 9, wherein the moisture body includes at least one drain positioned at a predetermined height and with a predetermined cross-sectional geometry and size to allow the moisture accumulated within the moisture body to drain at a predetermined rate.

12. The apparatus of claim 9, wherein the interior cavity of the lower portion includes a keyway and the shaft includes a corresponding key to prohibit rotational movement of the piston relative to the shaft.

13. The apparatus of claim 9, wherein at least a portion of mating portion includes a reflective substance adhered thereto.

14. The apparatus of claim 9, wherein two or more apparatuses are connected to some portion of a point to point physical connection that resides within recesses in a roadway surface between the two or more apparatuses.

15. The apparatus of claim 14, wherein the two or more road traction apparatuses each pull up some portion of the point to point connection, providing additional surface area for traction.

16. The apparatus of claim 9, further comprising one or more sealing members that engage an internal wall of the housing.

17. An apparatus for increasing road traction, comprising:

a housing with a first end and a second end, the first end closed and the second end open;

a shaft that engages the first end of the housing;

a piston that is adapted to move axially along a length of housing and includes an upper portion and lower portion, upper portion includes a raised surface adapted to provide improved traction for vehicles, a mating portion situated between the raised surface and lower portion and is adapted to mate with an inner surface of the housing such that the piston is reciprocally received therewithin, the lower portion including an interior cavity that is adapted to receive at least a portion of the shaft;

a spring that biases the piston towards the first end of the housing;

a toothed surface engaged with the piston; and a bimetal thermostat with a mating toothed surface, the bimetal thermostat secured with the housing at a proximal end;

one or more sealing members that engage an internal wall of the housing;

a step-like protruding member attached to the lower portion of the piston;

a keyhole that protrudes through a portion of the housing;

a key member that is adapted to slide within the keyhole;

a step-like protruding member attached to the lower portion of the piston;

a moisture container attached to an outside wall of housing such that moisture body substantially surrounds keyhole, with an opening at a first end to allow moisture to accumulate within the moisture body;

a moisture arm pivotably connected with the moisture body and pivotably connected with the key member; and a ball float positioned within the moisture body;

wherein when no contrary force is exerted against the piston, the spring biases the piston until the key member engages the step-like protruding member;

wherein as the moisture accumulates within the moisture body, the buoyancy of the ball float allows ball float to move upwards towards the first end of the moisture body and causes the ball float to engage and bias the moisture arm, which biases the key member such that a maximum height of the piston relative to roadway surface may increase by allowing more room for the travel of the step-like protruding member;

wherein the toothed surface engaged with the lower portion facilitates engagement with the mating toothed surface situated at a distal end of the bimetal thermostat when a temperature is above a predetermined threshold.

* * * * *